United States Patent [19]

Schultz et al.

[11] Patent Number: 4,755,100

[45] Date of Patent: Jul. 5, 1988

[54] OPERATOR CONTROL SYSTEM

[75] Inventors: Donald L. Schultz, Richland; Louis A. Haddock, Jr., Battle Creek, both of Mich.

[73] Assignee: Clark Equipment Company, South Bend, Ind.

[21] Appl. No.: 10,102

[22] Filed: Jan. 28, 1987

Related U.S. Application Data

[63] Continuation of Ser. No. 796,823, Nov. 12, 1985, abandoned.

[51] Int. Cl.[4] ..... G05G 9/04

[52] U.S. Cl. ..... 414/635; 74/471 XY; 74/471 R; 187/9 R; 187/9 E; 414/642; 414/667; 414/664; 414/659; 180/333; 180/315; 212/164; 60/551; 200/157; 137/636.3; 137/636.2

[58] Field of Search ..... 187/9 R; 414/635, 640, 414/667, 671, 909, 630, 4, 664, 628, 629, 631, 659, 668, 642; 74/471 XY, 471 R, 491; 244/480 R, 483 PB, 234, 237; 200/157.6 A; 137/363.2, 636.3; 180/333, 315; 212/162, 163, 164, 160, 159; 60/551

[56] References Cited

U.S. PATENT DOCUMENTS

| | | | |
|---|---|---|---|
| 2,456,320 | 12/1948 | Repke | 180/333 X |
| 3,179,198 | 4/1965 | Hastings, Jr. | 180/333 X |
| 3,209,612 | 10/1965 | Tönnies | 74/471 |
| 3,235,042 | 2/1966 | Ulinski | 180/315 X |
| 3,390,587 | 7/1968 | Ratliff, Jr. | 74/471 XY |
| 3,589,240 | 6/1971 | Levesque | 414/4 X |
| 3,811,336 | 5/1974 | Pulskamp | 414/635 X |
| 3,971,536 | 7/1976 | Rollins, Jr. | 74/471 R X |
| 4,348,634 | 9/1982 | David et al. | 901/22 X |

FOREIGN PATENT DOCUMENTS

| | | | |
|---|---|---|---|
| 1045799 | 10/1966 | United Kingdom | 414/4 |

*Primary Examiner*—Frank E. Werner
*Attorney, Agent, or Firm*—John C. Wiessler

[57] ABSTRACT

An operating control system for a lift truck controlled from a single multi-function operator hand control which is located and designed for improved operator comfort, convenience, simplicity and to reduce operator fatigue. The sole hand control for directional and speed control and the operation of all hydraulic functions of the truck related to the handling of loads is recessed in a compartment adjacent one side of the truck and supported from a control shaft which extends forwardly, leftwardly and downwardly and along which the control handle may be pushed or pulled linearly to control all such hydraulic truck functions. The grip handle is rotatable to control direction and speed of the truck. Switch controls are located conveniently adjacent the one end of the rotatable grip handle for selecting a variety of hydraulic functions by the same movements forwardly and rearwardly of the operator control handle along the control shaft. Electrical and hydraulic systems control the various hydraulic functions and are operatively connected to the control handle for operator selection of direction and speed of the truck as well as simultaneous operation of any selected hydraulic function one at a time only.

34 Claims, 5 Drawing Sheets

108
110
106
95
50
68
104
108
96
72
90
102
64
91
70
98
66
60
100
82
88
58
58
62
86
56
76
78
52
92
80
93
84
74
76
54

OPERATOR CONTROL SYSTEM

This application is a continuation of application Ser. No. 796,823, filed Nov. 12, 1985, now abandoned.

BACKGROUND OF THE INVENTION

This invention relates to controls for industrial lift trucks, and more particularly to an operator's manual control and to hydraulic, speed and directional functions controlled thereby.

The prior art includes various means which are intended to provide manual controls for reducing operator fatigue and single multi-function control assemblies. Exemplary of such prior art are U.S. Pat. Nos. 3,811,336 and 3,937,294.

SUMMARY OF THE INVENTION

The invention is concerned with human engineering and control functions in the manual control of a plurality of powered functions in the exemplary environment of a stand-up rider type industrial lift truck. An operator's handle assembly is designed and located so that the functions to be controlled are sense oriented, operator fatigue tends to be minimized whether the operator is driving the truck forwardly or rearwardly, and a support for the operator is provided during travel operations in either direction. The operator's control handle assembly is designed to be located in the operator's compartment on a bias to the longitudinal axis of the truck so that when in normal operating position it is not necessary that the operator turn his body to any substantial degree, but merely his head, in looking forwardly or rearwardly in those directions of truck operation.

The manual control handle is designed to operate linearly along the axis of a shaft in either direction in order to perform a multiplicity of hydraulic functions such as lift and lower, reach and retract, tilt forwardly and rearwardly, and side shift of the load support to the right and to the left. Electric relays are provided in an electric control system which is operatively connected to the manual control and to the hydraulic system whereby a single hydraulic valve may control any or all of the above hydraulic functions by the operator control handle as it is moved linearly along the shaft forwardly and rearwardly from a neutral position, said relays being armed for selected functions by means of conveniently located switch controls on the operator control handle. Directional control and truck speed control is provided by rotating the handle in either direction about its own axis from any position of displacement thereof along the shaft. The control is located in a recessed compartment which provides protection both for the operator and for the control, and it is an aesthetic pleasing design.

It is a principal object of the invention to provide a manual control for lift trucks, and the like, which utilizes human engineering principles so as to minimize operator fatigue during operation of the truck under all conditions.

It is an important object to provide such a manual control in which two basic motions only of the control by the operator are adapted to control all operating functions of the truck except steering, the hydraulic control functions being selectable at the control handle and operative one-at-a-time by the same control handle movements.

It is another object to provide cooperating electrical and hydraulic systems controlled by the control handle, the hydraulic system components which perform various hydraulic functions being controlled by a single valve and the hydraulic system components being interlocked with the electrical system such that the hydraulic functions are operable in any sequence, but only one-at-a-time.

Other objects, features and advantages of the invention will appear in the detailed description which follows when taken in conjunction with the accompanying drawings, wherein

DESCRIPTION OF THE PREFERRED EMBODIMENT

Figure 1:
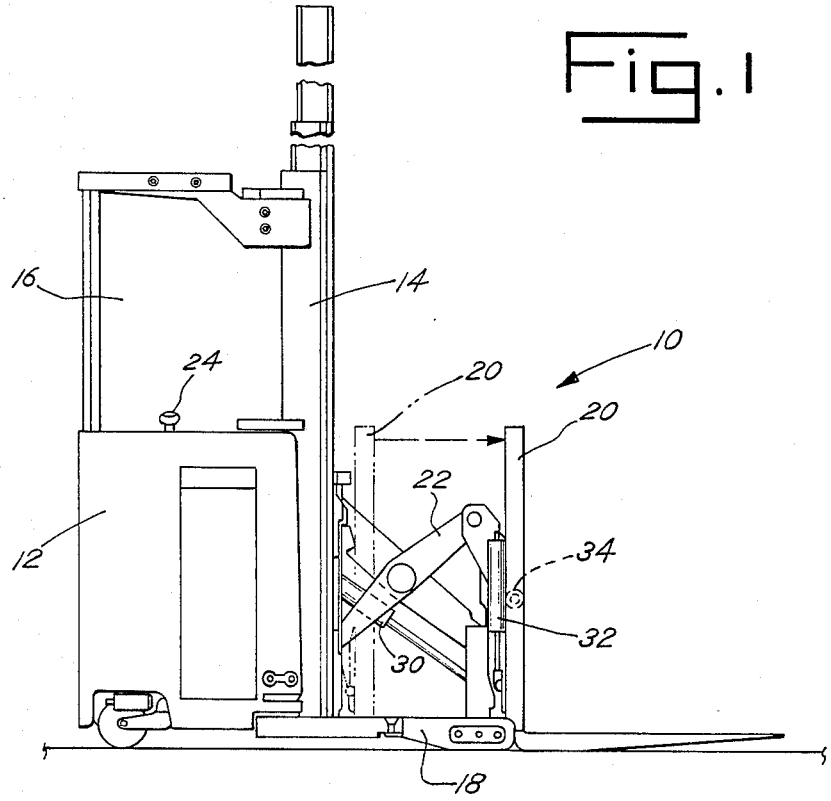
FIGS. 1 and 2 are simplified line drawings of a stand-up rider lift truck in side and plan views, respectively.
Figure 2:
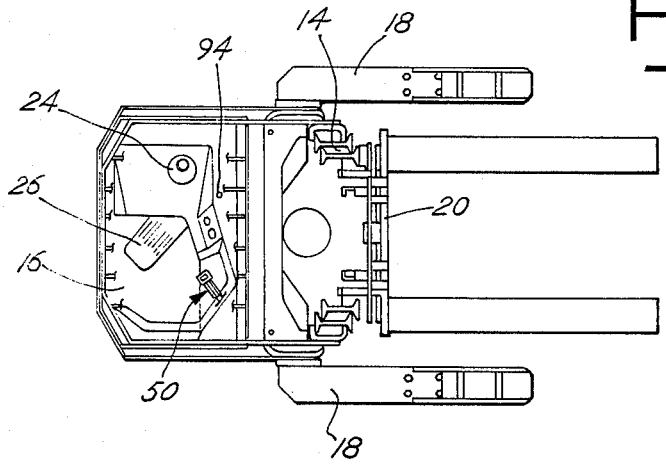

Referring now in detail to the drawing, and first to FIGS. 1 and 2, a stand-up rider lift truck is shown generally at numeral 10. It utilizes, as is usual, a wheel supported body section 12, upright 14, an operator's compartment 16, outrigger arms 18 extending forwardly of the body section, and a fork carriage 20 mounted at the outer end of a reach pantograph 22 which is in turn mounted at its inner end to a carriage supported from the telescopic upright, all in known manner.

In the operator's compartment is located a rotatable operator's steering control 24, a service brake pedal 26, and the operator's control assembly 50 of this invention. In known manner, a pair of reach cylinders 30 are mounted to extend and retract pantograph 22, a pair of tilt cylinders 32, one of which is shown, are mounted at the forward end of the pantograph for tilting the fork forwardly or rearwardly, and a side shift cylinder 34 is mounted on the fork carrier to side shift the fork assembly to the right or to the left.

Figure 3:
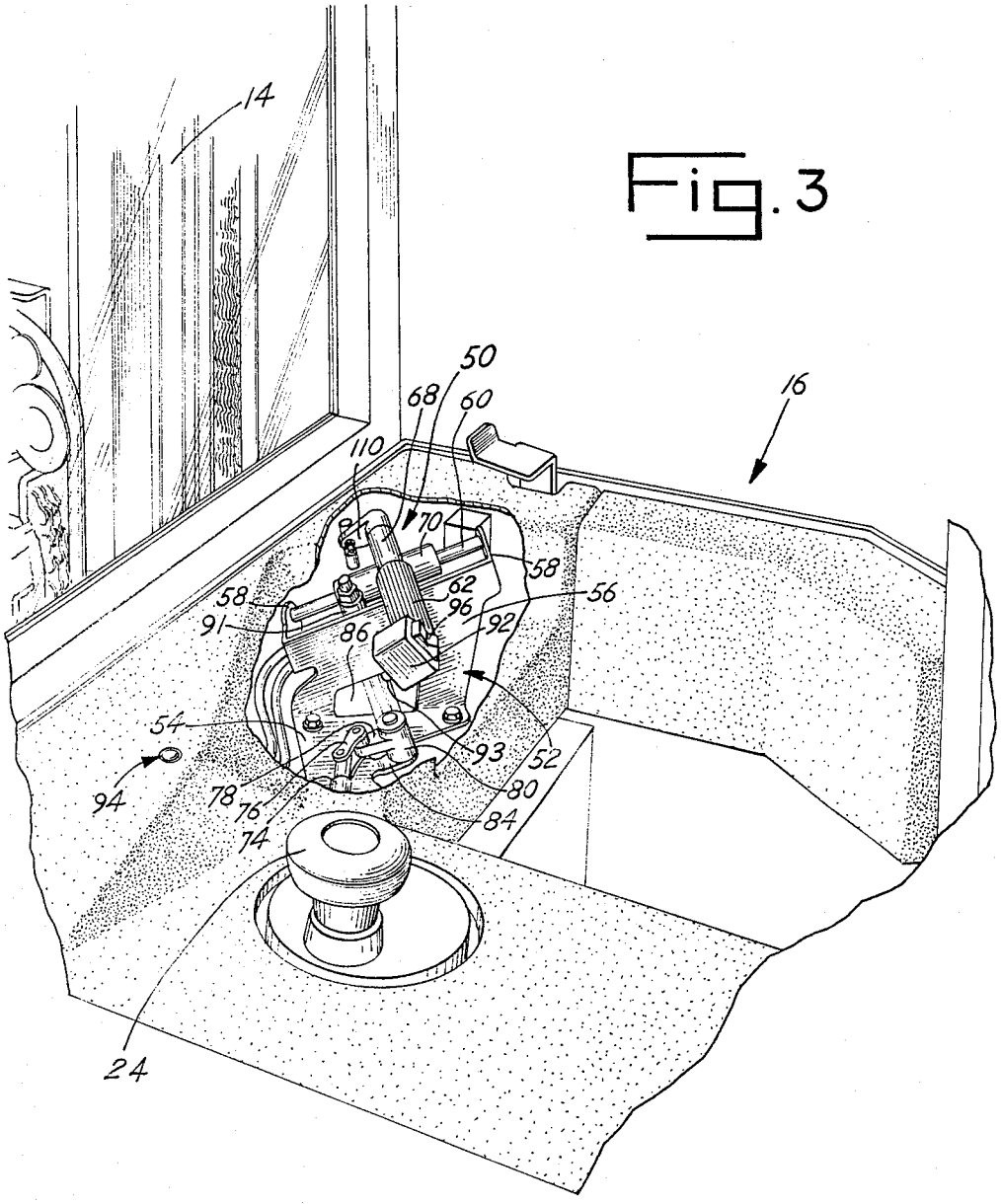
FIG. 3 is a broken away view of the operator's compartment.
Figure 4:
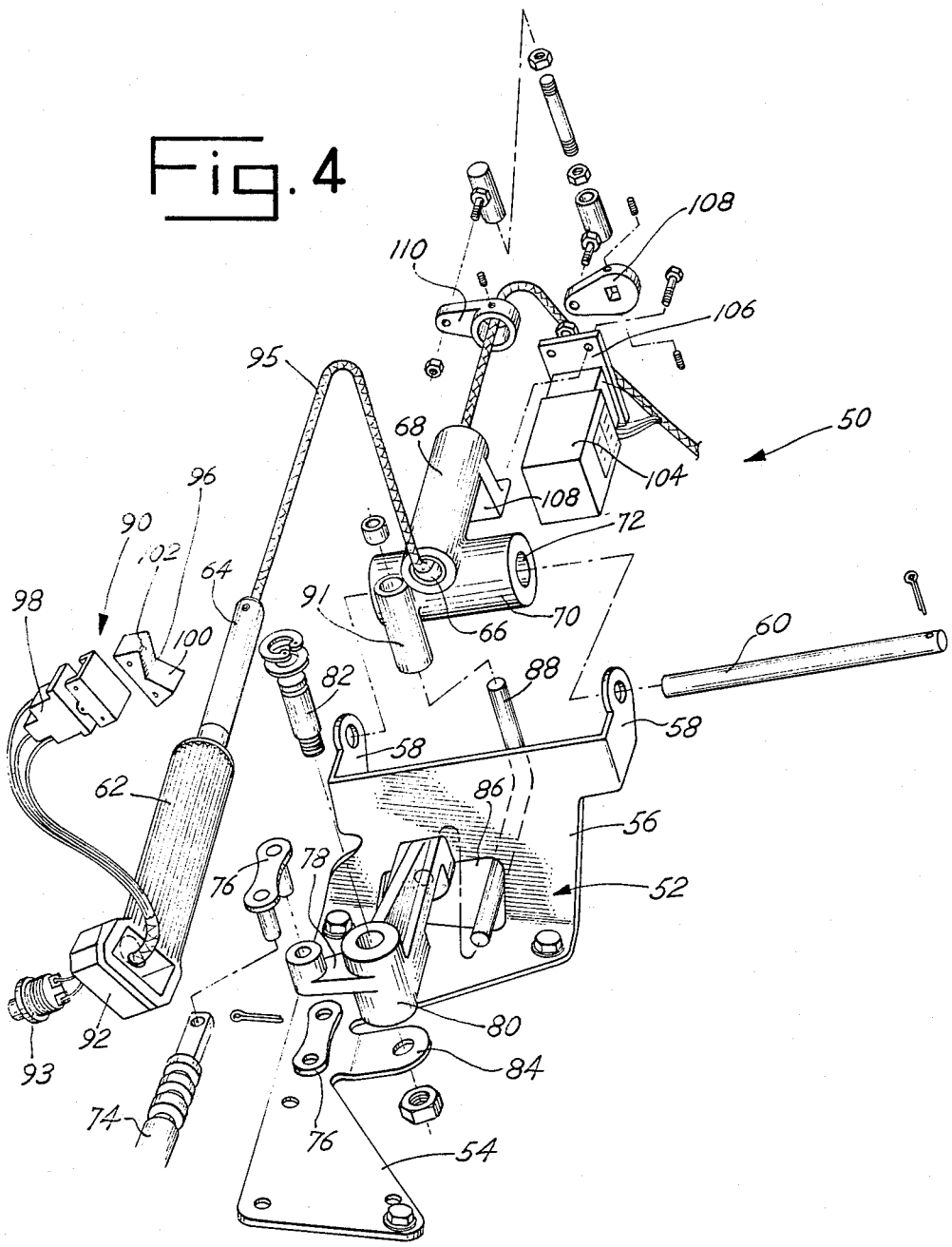
FIG. 4 is a perspective view showing the operator's handle control assembly in exploded view.

Referring now to FIGS. 3 and 4, the operator's manual control assembly is shown generally at numeral 50. It comprises a support bracket 52 formed as shown having a horizontal portion 54 mounted to a base plate beneath the operator's control by a plurality of bolts, a vertical section 56 having a relatively high rear end and low front end in order to provide for a downward tilt of the handle assembly, and a pair of outwardly extending ears 58 for receiving in openings thereof a control shaft 60. A control handle 62 is mounted by a projecting shaft 64 in opening 66 of a housing portion 68, the control handle and housing being mounted from control shaft 60 by a transverse portion 70 of the housing through which extends shaft 60 in opening 72.

Figure 5:
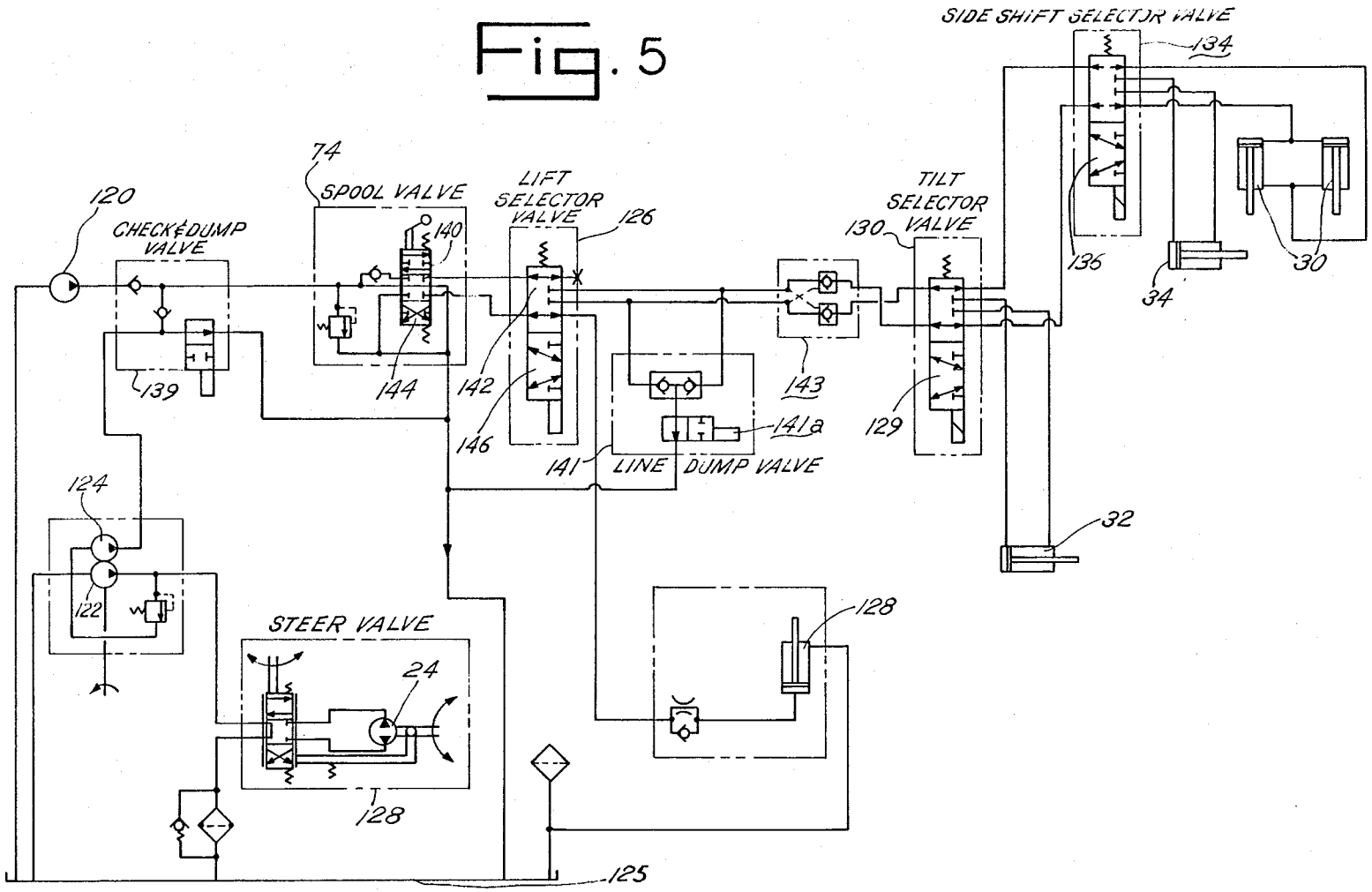
FIG. 5 is a schematic view of the major components of the hydraulic system.

The mounting bracket 52 is located at a bias to the longitudinal axis of the truck, the vertical portion 56 thereof being formed to extend forwardly and downwardly so that the handle control portion 62,68,70 is designed to be located at its most convenient and comfortable position in the operator's compartment. Manual control is effected whether operating the truck in a forward or rearward direction by movement of the handle control along the downward tilt and inward bias of shaft 60; this provides good operator "sense" control as the handle is actuated forwardly, downwardly and inwardly, or rearwardly, upwardly and outwardly along shaft 60 to control the various hydraulic functions of the lift truck, as best shown in FIG. 5, all as will become more apparent as the description proceeds.

All hydraulic functions of the truck except steering are controlled by means of a single spool valve 74 which is connected at its one end to a pair of links 76 in turn connected together through an opening in a boss at the end of a control lever 78 which extends outwardly of one side of a cast valve control lever 80 mounted for pivotal movement on a pin 82 which is secured in an ear 84 of bracket 52. Lever 80 extends through an opening 86 in bracket portion 56 and is mounted on the one end of an angled control rod 88 which is mounted in an opening of an upwardly extending handle housing control portion 91 such that when the handle control 62 is actuated linearly in either direction along shaft 60 the horizontal portion of control shaft rod 88 causes lever 80 to pivot in one direction or the other a distance which is proportional to the distance handle 62 is actuated along shaft 60 as the vertical portion of rod 88 pivots in housing portion 91, spool valve 74 via the resulting pivotal movement of lever 78 and links 76 to be actuated a similar proportional distance to actuate spool valve 74 thus to control the velocity of movement of the various hydraulic actuators illustrated in FIG. 5.

Control rod 88 is an important element in the manual control assembly 50 in that in the configuration and mounting of assembly 50 as disclosed, control rod 88 performs two important functions, viz, by its angled connection between housing portion 91 of handle control portion 62,68,70 and pivoted control lever 78,80 it both prevents handle control portion 62,68,70 from rotating on shaft 60 and actuates control lever 78,80 about pin 82 out of a neutral position in one direction or the other when the handle control portion is actuated linearly along shaft 60 in either direction thus actuating spool valve 74 as selected.

It will be noted that as the handle control is actuated forwardly along shaft 60 the vertical portion of rod 88 pivots about its axis in housing portion 91 in a counterclockwise direction, FIG. 4, while the horizontal portion thereof is thereby actuated to swing forwardly, thus pivoting lever 78,80 about pin 82. Reverse movements of the above mentioned parts occur when the handle control is actuated rearwardly along shaft 60.

Figure 6:
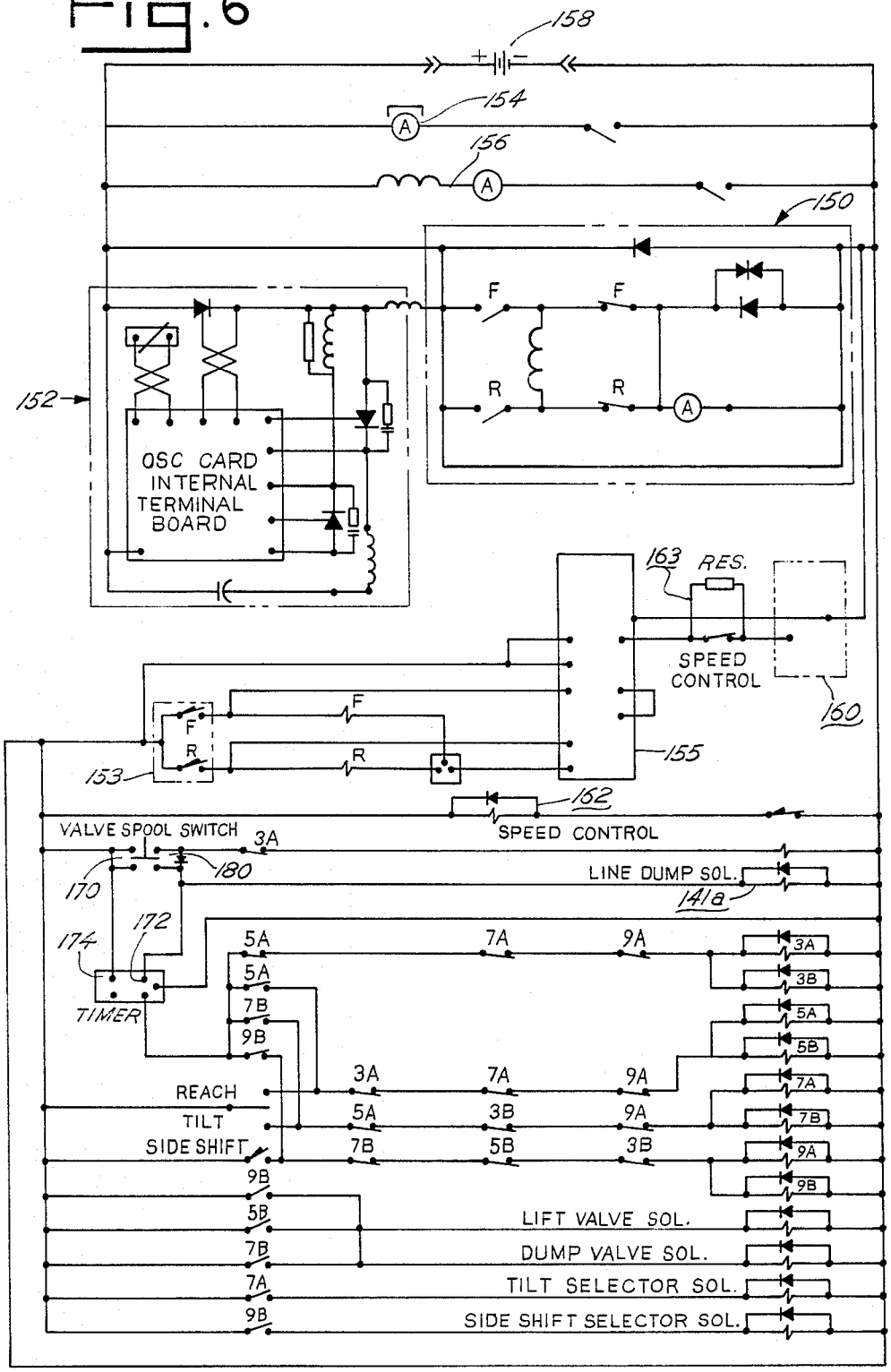
FIG. 6 is a schematic view of the major components of the electrical system which is operatively connected both to the hydraulic system and to the manual control.

A hydraulic control switch assembly 90 is mounted in a housing 92 located at one end of the control handle in a convenient position. It is operatively connected by an electrical control conduit 95 which extends through handle 62,64 and housing portion 68 to an electric control circuit system as shown in FIG. 6. A horn button 93 is mounted on the back side of the switch control assembly. A hydraulic function button 94 is mounted on the compartment cover panel for a purpose to be described.

A manual toggle switch 96 is mounted in housing 92 and is adapted to operate through a contactor box 98 connected through the various lead wires in conduit 95 to certain circuits in FIG. 6. Toggle 96 is normally located in a neutral position as shown at which movement of control handle 62 rearwardly along shaft 60 effected by a pulling motion of the operator effects through the circuits of FIGS. 5 and 6 via spool valve 74 a lifting function of the upright 14, whereas forward movement thereof on shaft 60 effects a lowering movement of the upright. The fork tilt function is controlled at toggle 96 by operator's thumb actuation of switch portion 100 which suitably conditions a tilt circuit in FIG. 6 to permit only a tilting function, all other hydraulic functions being locked out by suitably conditioning the electrical control circuits in FIG. 6 which energize the solenoids of the other function selector valves in FIG. 5. Forward movement of control handle 62 along shaft 60 effects operation of spool valve 74 in one direction which causes the fork to tilt forwardly relative to the upright whereas rearward movement along shaft 60 moves valve 74 in the opposite direction which causes the fork to tilt rearwardly. Actuation of the toggle portion 102 conditions the circuit of FIG. 6 to condition the circuit of FIG. 5 for extension and retraction of the pantograph 22. With switch portion 102 actuated, forward actuation of handle 62 causes extension of the pantograph while rearward actuation thereof causes retraction via actuation of spool valve 74 and the conditioning circuits of FIG. 6 to condition the selector valves of FIG. 5 to limit the hydraulic function to operation of the pantograph. Actuation of button 94 likewise conditions the circuits of FIGS. 5 and 6 to control side shifting of the fork to the right and to the left. To side shift left with button 94 depressed handle 62 is actuated forwardly and to side shift right with button 94 depressed handle 62 is actuated rearwardly. It will be noted that the longitudinal bias of shaft 60 from right to left as mounted in bracket 52 conforms also to the sense of the operator in respect of right and left side shift movements.

To reiterate, the control circuits of FIGS. 5 and 6 are so designed that no two hydraulic functions can be performed simultaneously, all but the selected one being locked out of circuit operation as will be described in more detail below. However, the direction and speed controls are independent of the circuits of FIGS. 5 and 6 and can be operated during the operation of any given hydraulic function.

A direction and speed control switch box is shown at 104, FIG. 4. It is mounted to a plate 106 which is supported from a portion 108 of housing 68, contactor box 104 being suitably connected as shown in FIG. 4 to control levers 108 and 110. Rotary actuation of handle 62 causes the projecting shaft 64 thereof to actuate lever 110 which in turn is operatively connected to lever 108 so that actuation thereof conditions the respective direction and speed control circuits of FIG. 6 to operate the truck forwardly or rearwardly at a selected speed which is a function of the degree of rotation of handle 62 about its axis. Forward or counterclockwise rotation of handle 62 conditions the truck for forward operation at a selected speed while rearward or clockwise rotation conditions the circuit for rearward operation of the truck at a selected speed. Control box 104 produces a variable voltage to an SCR control 152, the voltage being established by the degree of rotation of the shaft in item 104. The rotation of the latter shaft also actuates switches which control the travel direction of the truck.

Referring again to FIG. 5, prime mover driven lift, steer and auxiliary pumps are shown at 120, 122, and 124 respectively. A hydraulic reservoir is illustrated at 125. A steer valve and control is illustrated schematically at 128 wherein the operator steering control 24 is shown. The manually controlled spool valve 74 is shown in circuit with a lift selector valve 126 which controls the operation of a lift cylinder 128, a tilt selector valve 130 which controls the operation of the pair of tilt cylinders 32, and a side shift selector valve 134 which controls at the operator's option either the pair of pantograph reach cylinders 30 or the fork side shift cylinder 34. A double check and dump valve 139 controls fluid flow from pumps 120 and 124. One of the check valves in valve 139 in circuit with spool valve 74 prevents fluid flow from pump 124 back through pump 120 and the other check valve prevents fluid flow from pump 120 back through the dump valve of valve 139. A line dump valve 141 is also in circuit as shown with spool valve 74 and the various selector valves; it limits hydraulic pressure to 50 psi in the upright hoses, not shown, except when an auxiliary hydraulic function (reach, tilt or side shift) is operative. A double pilot operated check valve 143 prevents fluid flow from such auxiliary function actuator cylinders 30, 32 and 34 except when the other side of any of said actuators is pressurized.

Each of the above mentioned valves, except spool valve 74 and check valve 143, are solenoid actuated as illustrated. As shown in FIG. 5 all of the selector valves 126, 130 and 134 are in condition such that actuation of spool valve 74 by actuation of control handle 62 along shaft 60 in a rearward direction will effect elevation of lift cylinder 128 and of the upright 14, whereas forward movement of control handle 62 will effect lowering movement of the lift cylinder and the upright. The normal condition of the FIG. 5 circuit is as illustrated. As will be apparent, upward movement of valve 74 connects lift pump 120 to the lift cylinder via valve sections 144 and 142 of valves 74 and 126, respectively, whereas lowering movement of the lift cylinder is effected by actuation of control handle 62 forwardly which effects downward movement of valve 74 and lowering of the lift cylinder via valve sections 140 and 142 of said valves, said other selector valves 130 and 134 being rendered inoperative by the position of lift selector valve 126.

If any one of valves 130 or 134 is conditioned by operation of toggle switch 96 or button 94 to tilt, reach or side shift then lift valve 126 is actuated to make operative a valve section 146 which by-passes the circuit to lift cylinder 128 and connects through pilot check valve 143 with either tilt cylinders 32, reach cylinders 30 or side shift cylinder 34 depending upon the condition of the circuit of FIG. 6 as related to the operation of toggle 96 or switch 94, as previously described. Referring now more specifically to FIG. 6, the drive motor circuit and assembly is schematically illustrated at numeral 150, an SCR drive motor speed control generally at 152, and directional switch and control at 153 and 160 having an SCR control card for directional and speed control at 155. Power steer and pump motor circuits are shown at 154 and 156, respectively, and a 24 volt battery supply at 158. Inasmuch as the aforementioned circuits have no specific bearing upon the invention they have been schematically illustrated only in part.

All of the switches and contactors in circuit are shown in their normally open or normally closed positions. With the drive motor circuit 150 in operation, handle control 62 operates forward or reverse switches 153 initially upon rotary movement in one direction or the other of control handle 62 whereupon the lift truck may be operated in one direction or the other at selected speeds via directional switch 153 and speed control 160,162,163 operating through speed control switch box 104 and its operative connection to control handle 62 via levers 108 and 110. Below speed control coil 162 is located in the circuit schematic a plurality of circuit lines, switches and relay coils as identified by legends on the circuit lines. A plurality of switches identified by odd numbers and letters from 3A,3B through 9A,9B are controlled by toggle 96 and button 94 to condition the various solenoid actuators of the respective selector valves of FIG. 5 so that one selected hydraulic function only may be operative at a given time. More specifically, the lift cylinder is operated to elevate when the operator pulls back the control handle along shaft 60 from its neutral position which initially closes one set of contacts in a valve spool switch 170 which then applies voltage to a terminal 172 on an electronic timer 174 which then applies voltage to relay coils 3A and 3B which conditions all 3A and 3B contactors to open or close from the normally closed or open positions illustrated to complete the circuit to the lift motor contactor coil turning it on so that pressure fluid is directed to lift cylinder 128 from pump 120 through spool and lift valves 74 and 126. Certain contactors 3A and 3B are open which provide an electrical interlock prohibiting other hydraulic functions from being performed simultaneously. Lift speed is controlled by the spool of valve 74 as a function of the displacement of control handle 62 rearwardly along control shaft 60 from its neutral position.

To lower the lift cylinder and upright the operator displaces control handle 62 forwardly of its neutral position on shaft 60 thereby initially closing the other set of contacts in switch 170 which again applies voltage to terminal 172 and thence to contactors 3A and 3B. However, the circuit to the lift motor contactor coil is not completed because a rectifier 180 at switch 170 blocks current flow to the closed contactor 3A in that circuit preventing the operation of lift pump 120. Again, certain contactors are open which provide an electrical interlock prohibiting other hydraulic functions from being performed simultaneously.

It should be understood that whenever the operator selects a hydraulic function via any one of the selector valves, movement in either direction of the control handle always initially closes switch 170 in one direction which is circuited through certain of the contactors, depending on the function selected, to always initially energize solenoid **141*a* which closes line dump valve 141 thus permitting pressure fluid flow solely to the selected actuator cylinder. In respect of each and all hydraulic selector valve operations the electronic timer 174** functions whenever the control handle is returned to a neutral position to keep open the prior actuated selector valve for a very brief period of time (such as 1/10 second) so that system line pressure can dump to a low pressure (such as 50 psi) prior to operation of the next hydraulic function selected when the control handle is again moved out of neutral. Hydraulic functions can be selected only when the control handle is in neutral.

Retracting an extended pantograph 22 is accomplished when the operator depresses the reach/retract portion 102 of toggle 96 and pulls back on control handle 62 which actuates portion 144 of valve 74 into an operative position. Depressing switch portion 102 energizes relay coils 5A and 5B. Certain contactors 5A and 5B close which energizes the solenoid of dump valve 139 which directs pressure fluid from pump 124 to valve 74. Switch portion 102 can be released by the operator after the control handle is initially moved to close the contacts in valve spool switch 170 without interrupting the retract function. Other contactors 5A and 5B are opened which provide an electrical interlock which prohibits other hydraulic functions from being performed simultaneously. Still other contactors 5A,5B close which actuate the selector valve solenoid at valve 126 thus directing pressure fluid to retract cylinders 30 while the same conditions pertain as above to retract cylinders 30. The speed of retraction of the pantograph is controlled by the displacement of control handle 62 rearwardly from a neutral position.

The reach function of the pantograph is activated in a similar manner when the operator depresses toggle portion 102 and pushes the control handle forwardly which closes the opposite set of contacts in switch 170.

The fork tilt back function is performed when the operator depresses portion 100 of toggle 96 and pulls rearwardly control handle 62 to actuate switch 170 and engage portion 144 of valve 74. This energizes relay coils and contactors 7A and 7B, certain of which close to energize the relay coils of the lift valve solenoid to engage valve portion 146 and the tilt selector solenoid to engage valve portion 129 as well as that of dump valve 139, thus retracting cylinders 32. Other contactors 7A and 7B close which permits portion 100 of toggle 96 to be released without interrupting the tilt back function as above described. Again, contactors are conditioned to prohibit other hydraulic functions from being performed simultaneously as above described. Tilt speed is controlled by valve spool position related to control handle displacement rearwardly from a neutral position.

The tilt forward function is performed by the operator by again depressing toggle switch portion 100 and pushing the control handle forwardly from its neutral position, the same conditions existing as for tilt back except that valve portion 140 of valve 74 is engaged.

The side shift right function is performed by the operator depressing button 94 and pulling rearwardly the handle on shaft 60 which energizes relay coils and contactors 9A and 9B and engages valve portion 144. Specific contacts 9A and 9B close which energizes the solenoid of dump valve 139, and the solenoid of the lift selector valve to engage valve portion 146 of the lift selector valve and the solenoid of the side shift selector valve 134 to engage valve portion 136. Another set of contacts 9A and 9B close which permits the operator to release button 94 following actuation of the control handle rearwardly to close contacts in valve spool switch 170 without interrupting the side shift right function. Other contacts 9A and 9B are open which provide an electrical interlock prohibiting other functions from being performed simultaneously as above described. The side shift speed is controlled by the displacement of the valve spool position from neutral as above described.

The side shift left function is performed the same as the side shift right function above described except that valve portion 140 of valve 74 is engaged.

At any longitudinal control position of the control handle 62 on shaft 60 in the operation in any one of the above described hydraulic functions the control handle may be also rotated forwardly or rearwardly to control direction and speed of operation of the lift truck via certain control circuits of FIG. 6 as above described. The overall control handle operation and structure is extremely novel in the manner of mounting and control of all functions of the lift truck except steering by means of rotational movement of handle 62 to control direction and speed and linear axial movement to control all hydraulic functions in either direction and in any serial order selected by an operator.

The mounting and design of the control handle is such that it is comfortable and easy for the operator to operate. The sliding linear motion controlling all hydraulic functions requires no wrist motion so that the travel and speed function will not be inadvertently operated during control of hydraulic functions. The operating control system requires two hoses only and a three wire electrical cable in the upright which enhances operator visibility.

It will be apparent to those skilled in the art that various changes in the structure and relative arrangement of parts may be made without necessarily departing from the scope of my invention as defined in the claims appended.

We claim:

1. In an industrial lift truck having at least ground traversing and lifting functions with an operator's station, an operator's control asembly comprising internal shaft means, said shaft means having a shaft with an outer supporting surface and supported from the operator's station and an operator control slidably mounted on said shaft generally centrally thereof when in a neutral position, said operator control being operatively connected to control means to control a plurality of different truck functions, said operator control being actuatable forwardly from neutral position along said shaft means to control by said control means the operation of each of said different truck functions in a first mode and being actuatable rearwardly from neutral position along said shaft means to control by said control means the operation of each of said different truck functions in a second mode.

2. An operator control assembly as claimed in claim 1 wherein said operative connection includes a rigid control element having upwardly and outwardly extending poritons engaging said operator control to prevent rotation thereof on said shaft means and operatively connected to said control means to actuate the latter when said operator control is actuated on said shaft means.

3. An operator control assembly as claimed in claim 1 wherein said operative connection includes rigid angled connecting means between said operator control and an element of said control means which is actuatable with said operator control, said connecting means being adapted to prevent said operator control from rotating on said shaft means and adapted to actuate said element of said control means.

4. An operator control assembly as claimed in claim 3 wherein said element of said control means comprises pivotable lever means, said rigid connecting means being mounted in such a manner that it is caused to pivot in relation to said operator control during actuation thereof on said shaft means and engages a movable end of said lever means for actuating said movable end about a pivotable mounting of said lever means during actuation of said operator control.

5. An operator control assembly as claimed in claim 4 wherein said rigid connecting means comprises an angled rod means one end portion of which engages said operator control and the other end portion of which engages said lever means.

6. An industrial lift truck having at least ground traversing and lifting functions with an operator's station, an operator's control assembly comprising shaft means supported from the operator's station and an operator control slidably mounted on said shaft means for actuation in either direction along said shaft means, said operator control being operatively connected to valve means for controlling a plurality of different hydraulic truck functins, said operative connection including pivotable lever means supported from the operator's station connected to said valve means and rigid angled means connecting said operator control and said lever means such that actuation of said operator control in either direction along said shaft means actuates said angled connecting means to pivot in relation to the operator control which causes said lever means to pivot and actuate said valve means.

7. A industrial lift truck as claimed in claim 6 wherein said operator control and said lever means extend generally transversely of and in the same direction from said shaft means.

8. An operator control assembly as claimed in claim 1 wherein said shaft means is mounted on a bias to the central longitudinal axis of the lift truck.

9. An operator control assembly as claimed in claims 1 or 2 or 6 wherein said shaft means extends forwardly of the truck at a downwardly and leftwardly disposed inclination.

10. An operator control assembly as claimed in claim 6 wherein said operator control includes a plurality of bearing means secured one to another and mounted for movement as a unit on said shaft means.

11. An operator control assembly as claimed in claim 10 wherein one of said bearing means is mounted for sliding movement on said shaft means.

12. An operator control assembly as claimed in claim 11 wherein a second of said bearing menas is secured in substantially perpendicular relation to said one bearing means.

13. An operator control assembly as claimed in claim 12 wherein said second bearing means supports the vertical leg of said angled rod element.

14. An operator control assembly as claimed in claim 12 wherein a third of said bearing menas is secured to one of said other bearing means for supporting an operator control handle of said operator control.

15. An operator control assembly as claimed in claim 12 wherein said lever means is mounted to pivot on an axis which is substantially parallel to the axis of said second bearing means.

16. An operator control assembly as claimed in claim 11 wherein a second of said bearing means is secured to said one bearing means and said lever means is mounted to pivot on an axis which is substantially parallel to the axis of said second bearing means.

17. An operator control assembly as claimed in claim 16 wherein one leg of said angled connecting means is mounted in said bearing means and a second leg thereof is mounted in a portion of said lever means.

18. An operator control assembly as claimed in claim 17 wherein actuation of said operator control along said shaft means actuates said angled connecting means to pivot in said second bearing means and to pivot said lever means on said parallel axis whereby to actuate said valve means.

19. An operator contorl assembly as claimed in claim 6 wherein said connecting means is a right angled connecting rod.

20. An operator control assembly as claimed in claims 1 or 6 wherein said operative connection also includes a control system which limits the operation of said different truck functions to one only at a given time during actuation of the operator control forwardly or rearwardly of said shaft means.

21. An operator control assembly as claimed in claims 1 or 6 wherein said operator control includes switch means to provide natural and easy access thereto by the operator and to provide operation in either direction of one truck function when the switch means is actuated in one direction and to provide operation in either direction of a second truck function when said switch means is actuated in the opposite direction.

22. An operator control assembly as claimed in claim 1 or 6 wherein said operator contorl includes a control handle adapted to be rotated about its own axis by the operator for controlling direction and speed of the lift truck in either direction, said operator control being adapted to be pushed forwardly by the operator along said shaft means to control said plurality of different truck functions by means of an operative connection thereof to hydraulic actuators.

23. An operator control assembly as claimed in claim 1 wherein said operator control is operatively connected to valve means which is operatively connected to a plurality of hydraulic actuators for controlling said different truck functions, which valve means is actuated variably open operator control is actuated along said shaft means in either direction away from neutral position.

24. An operator control assembly as claimed in claims 6 or 23 wherein said operative connection to control said different functions includes electrical control means interconnected in such a manner that only one of said truck functions is operable at any given time and all of said truck functions may be operated in any selected sequence by the operator of said operator control on said shaft means.

25. An operator control assembly as claimed in claims 6 or 23 wherein said lift truck includes an upright having means for extending and retracting load support means connected thereto, an hydraulic actuator for extending and retracting said load extension means, said operator control being adapted to control said latter actuator in either direction during displacement thereof in one or another direction along said shaft means, said operator control being operatively connected to said latter actuator by electric and hydraulic system means.

26. An operator control assembly as claimed in claim 25 wherein a side shift cylinder actuator is mounted to side shift said load support means relative to said load extension means to the right or to the left, said side shift actuator being operatively connected to said operator control by said electrical and hydraulic system means.

27. An operator control assembly as claimed in claim 23 wherein said hydraulic actuators include hydraulic system lift and tilt actuator cylinders, and lift selector valve means operatively connected to said lift and tilt cylinders and to each other, and wherein lift truck includes an upright, load support means connected to said upright for elevation relative thereto by pantograph means adapted to extend and retract said load support means, reach cylinder means connected to extend and retract said pantograph means, selector valve means operative to extend and retract said reach cylinder means, and cooperating electrical and hydraulic system means controlled by said operator control and functioning in such a manner that said lift cylinder, tilt cylinder and reach cylinder are operative one at a time and in any sequence by displacement of said operator control in either direction along said shaft means.

28. An operator control assembly as claimed in claim 21 wherein displacement of the operator control forwardly on said shaft means with said switch means unactuated effects a lowering funciton while rearward displacement thereof effects a lifting function, forward displacement of said operator control with operation of said switch means in one direction effecting a forward tilt function while rearward displacement thereof effects a rearward tilt function.

29. An operator control assembly as claimed in claim 28 wherein forward displacement of said operator control with said switch means operated in the other direction effects a reach function while displacement of the operator control in the opposite direction effects a retract function.

30. An operator control assembly as claimed in claim 28 wherein the velocity with which each said function is executed is proportional to the displacement of said operator control on said shaft means in either direction from a neutral position.

31. An operator control assembly as claimed in claim 28 wherein an electrical control system includes electrical interlocks limiting the operation of said different truck functions to one at a time.

32. An operator control assembly as claimed in claim 31 wherein a hydraulic system controls the operation of said plurality of different functions and is operatively connected to said electric control system in a manner such that valve means controlling the operation of each of said different functions cooperate together to limit said one-at-a-time function operation.

33. An operator control assembly as claimed in claim 32 wherein said operator control is operatively connected to said hydraulic system by a single spool valve means which is displaced as a function of the displacement in either direction of the operator control along said shaft means for controlling the direction and velocity of each of said different functions in cooperation with said hydraulic system valve means.

34. An operator control assembly as claimed in claims 1 or 6 wherein said operator control functions through a single valve means to direct pressure fluid to one or another of a plurality of hydraulic valve means and actuators for selectively controlling said different truck functions.

* * * * *